US011545777B2

(12) United States Patent
Sundarakrishnamachari et al.

(10) Patent No.: US 11,545,777 B2
(45) Date of Patent: Jan. 3, 2023

(54) COAXIAL CONNECTOR ASSEMBLY

(71) Applicant: Aptiv Technologies Limited, St. Michael (BB)

(72) Inventors: Rangarajan Sundarakrishnamachari, Chennai (IN); Lokesh Dayalan, Vellore (IN)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 17/365,038

(22) Filed: Jul. 1, 2021

(65) Prior Publication Data

US 2022/0029336 A1 Jan. 27, 2022

Related U.S. Application Data

(60) Provisional application No. 63/055,955, filed on Jul. 24, 2020.

(51) Int. Cl.
*H01R 13/424* (2006.01)
*H01R 13/436* (2006.01)
*H01R 24/38* (2011.01)

(52) U.S. Cl.
CPC ..... *H01R 13/424* (2013.01); *H01R 13/4361* (2013.01); *H01R 24/38* (2013.01)

(58) Field of Classification Search
CPC .. H01R 24/38; H01R 13/424; H01R 13/4361; H01R 13/4362; H01R 13/506; H01R 13/508; H01R 13/4223; H01R 13/426
See application file for complete search history.

(56) References Cited

U.S. PATENT DOCUMENTS 6,811,451 B2 * 11/2004 Mase ..... H01R 13/4362 439/752
6,827,609 B1 * 12/2004 Martin ..... H01R 13/4365 439/595
7,044,808 B1 * 5/2006 Foltz ..... H01R 13/4362 439/752
7,195,522 B2 * 3/2007 Okada ..... H01R 13/4362 439/752
7,347,745 B1 3/2008 Raudenbush et al.
(Continued)

FOREIGN PATENT DOCUMENTS

DE 202008014541 U1 1/2009
EP 3159970 A1 4/2017
(Continued)

OTHER PUBLICATIONS

Extended European Search Report for EP Application No. 21186940.9, dated Dec. 12, 2020, 11 pages.

*Primary Examiner* — Marcus E Harcum
(74) *Attorney, Agent, or Firm* — Billion & Armitage

(57) ABSTRACT

A connector assembly includes a connector housing defining a cavity, a cylindrical terminal disposed within the cavity, a primary terminal locking feature configured to retain the cylindrical terminal within the cavity, and a secondary terminal locking feature configured to retain the cylindrical terminal within the cavity. The secondary terminal locking feature has a pair of arms defining concave features that engage the cylindrical terminal as the concave features of the pair of arms are wedged between the cylindrical terminal and inner walls of the cavity.

11 Claims, 12 Drawing Sheets

(56) References Cited

U.S. PATENT DOCUMENTS

| | | | | |
|---|---|---|---|---|
| 7,625,251 | B2 * | 12/2009 | Martin | H01R 13/4223 439/752 |
| 7,762,854 | B1 * | 7/2010 | Peng | H01R 24/50 439/752 |
| 9,882,317 | B1 * | 1/2018 | Lane | H01R 13/4223 |
| 9,960,550 | B2 * | 5/2018 | Ensley | H01R 24/38 |
| 10,461,457 | B1 * | 10/2019 | Aono | H01R 13/4223 |
| 10,892,577 | B1 * | 1/2021 | Probert | H01R 13/424 |
| 2007/0054543 | A1 * | 3/2007 | Moll | H01R 13/518 439/489 |
| 2009/0011637 | A1 | 1/2009 | Kim | |
| 2009/0130902 | A1 * | 5/2009 | Hall | H01R 27/02 439/595 |
| 2009/0269963 | A1 * | 10/2009 | Brown | H01R 13/4362 439/357 |
| 2017/0110838 | A1 * | 4/2017 | Sasaki | H01R 13/5205 |
| 2017/0207578 | A1 * | 7/2017 | Abraham | H01R 13/4362 |
| 2018/0026408 | A1 * | 1/2018 | Ensley | H01R 24/38 439/578 |
| 2019/0006781 | A1 * | 1/2019 | Hung | H01R 13/4367 |
| 2019/0067864 | A1 * | 2/2019 | Kon | H01R 13/74 |
| 2019/0181580 | A1 * | 6/2019 | Rangi | H01R 13/501 |
| 2020/0153144 | A1 | 5/2020 | Dupont et al. | |
| 2020/0295494 | A1 * | 9/2020 | Fernandes | H01R 13/629 |
| 2020/0295496 | A1 * | 9/2020 | Jabrane | H01R 13/639 |

FOREIGN PATENT DOCUMENTS

| | | | |
|---|---|---|---|
| JP | 2019153464 | A | 9/2019 |
| KR | 101482973 | B1 | 1/2015 |
| KR | 20170070997 | A | 6/2017 |

* cited by examiner

COAXIAL CONNECTOR ASSEMBLY

CROSS-REFERENCE TO RELATED APPLICATION

This application claims the benefit of priority to U.S. Provisional Patent Application No. 63/055,955 filed on Jul. 24, 2020, the entire disclosure of which is hereby incorporated by reference.

BACKGROUND

Achieving the desired terminal retention forces for miniaturized coaxial connectors is very difficult due to low profile geometries required of the primary and secondary terminal locking features and the terminal position assurance devices. Due to the circular geometry of the coaxial cavity, it is difficult for the secondary locking feature to overlap with the terminal. Therefore, a coaxial connector that addresses these shortcomings is desired.

The subject matter discussed in the background section should not be assumed to be prior art merely because of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY

According to one embodiment of the invention, a connector assembly is provided. The connector assembly includes a connector housing defining a cavity, a cylindrical terminal disposed within the cavity, a primary terminal locking feature configured to retain the cylindrical terminal within the cavity, and a secondary terminal locking feature configured to retain the cylindrical terminal within the cavity. The secondary terminal locking feature has a pair of arms defining concave features that engage the cylindrical terminal as the concave features are wedged between the cylindrical terminal and inner walls of the cavity.

In an example embodiment having one or more features of the connector assembly of the previous paragraph, the concave features are wedged between the cylindrical terminal and inner walls of the cavity as the secondary terminal locking feature is moved from a pre-staged position to a staged position.

In an example embodiment having one or more features of the connector assembly of any one the previous paragraphs, the inner walls of the cavity form a ramp configured to deflect the pair of arms in an axial direction toward the cylindrical terminal as the secondary terminal locking feature is moved from the pre-staged position to the staged position.

In an example embodiment having one or more features of the connector assembly of any one the previous paragraphs, the secondary terminal locking feature is configured to bias the cylindrical terminal toward a forward stop when in the staged position.

In an example embodiment having one or more features of the connector assembly of any one the previous paragraphs, a radius of the concave features is substantially equal to an outer radius of the cylindrical terminal.

In an example embodiment having one or more features of the connector assembly of any one the previous paragraphs, the secondary terminal locking feature defines pre-locking features configured to secure the secondary terminal locking feature to the connector housing in a pre-staged position.

In an example embodiment having one or more features of the connector assembly of any one the previous paragraphs, the connector housing is configured to contain a male connector or a female connector.

In an example embodiment having one or more features of the connector assembly of any one the previous paragraphs, the connector housing is configured to contain two or four cylindrical terminals.

In an example embodiment having one or more features of the connector assembly of any one the previous paragraphs, the cylindrical terminal is a coaxial terminal.

In an example embodiment having one or more features of the connector assembly of any one the previous paragraphs, the cylindrical terminal is a coaxial electrical terminal and is attached to a coaxial electrical cable.

According to one embodiment of the invention, a coaxial electrical connector assembly is provided. The coaxial electrical connector assembly includes a connector housing defining a cavity, a cylindrical coaxial terminal attached to a coaxial cable that is disposed within the cavity, a primary means for retaining the cylindrical terminal within the cavity, and a secondary means for retaining the cylindrical terminal within the cavity movable from a pre-staged position to a staged position and having concave features that are wedged between the cylindrical terminal and inner walls of the cavity when in the staged position.

BRIEF DESCRIPTION OF THE DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

A coaxial connector assembly that provides a solution to overcome the issues described in the BACKGROUND section by clamping the terminal around its circular geometry while reinforcing the terminal cavity primary locking feature and pushing the terminal toward a forward stop via a wedging action is presented herein. The coaxial connector assembly includes an integrated secondary lock (ISL) feature that has greater overlap with the coaxial terminal and is supported by a wedging action along a lateral axis of the connector. The ISL pushes the coaxial terminal in an axial mating direction to arrest the gap between a flexible primary locking feature in the cavity and a forward stop supported by a ramp wedge arrangement in the cavity. The ISL is integrated with a primary lock reinforcement (PLR) feature. The ISL backs up the terminal cavity primary locks when moved to final staged position. The wedging action of the ISL in the axial mating direction reduces or eliminates the load transferred to the primary locking feature in the cavity by the terminal during contact engagement.

Figure 1:
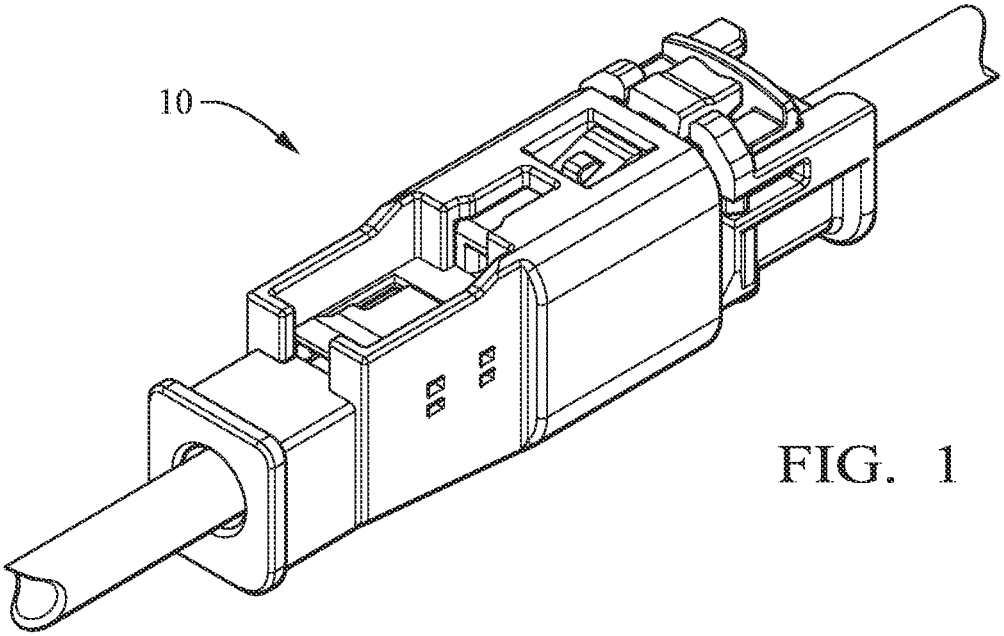
FIG. 1 is a perspective view of a coaxial connector assembly according to some embodiments.
Figure 2:
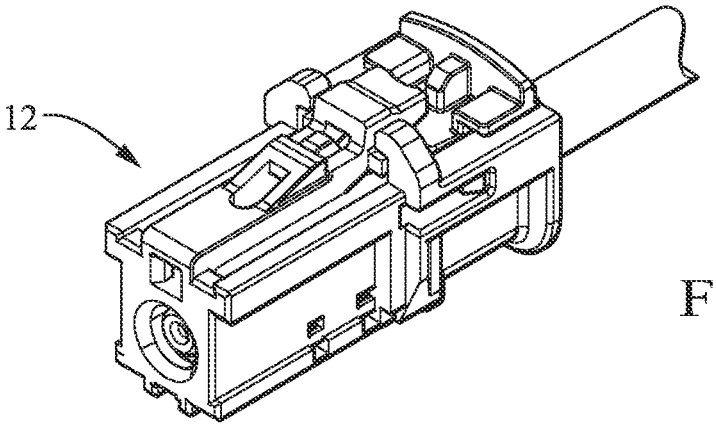
FIG. 2 is a perspective view of a female coaxial connector assembly of the coaxial connector assembly of FIG. 1 according to some embodiments.
Figure 3:
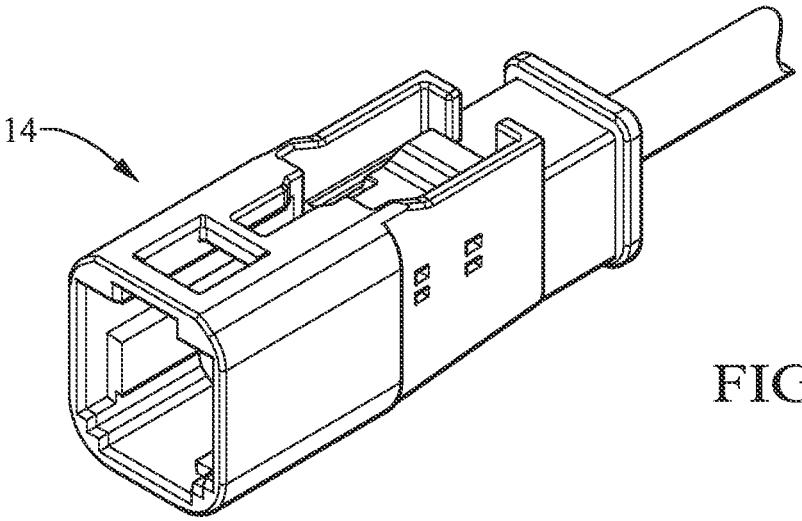
FIG. 3 a is perspective view of a male coaxial connector assembly of the coaxial connector assembly of FIG. 1 according to some embodiments.
Figure 4:
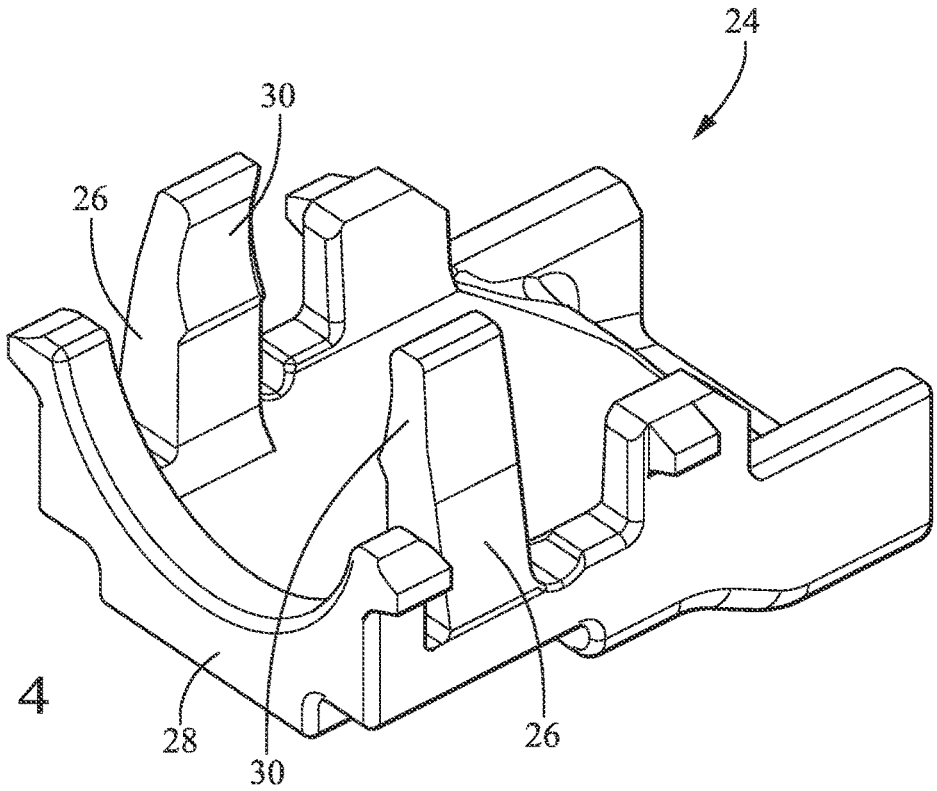
FIG. 4 is a front perspective view of an independent secondary lock of the female coaxial connector assembly of FIG. 2 according to some embodiments.
Figure 5:
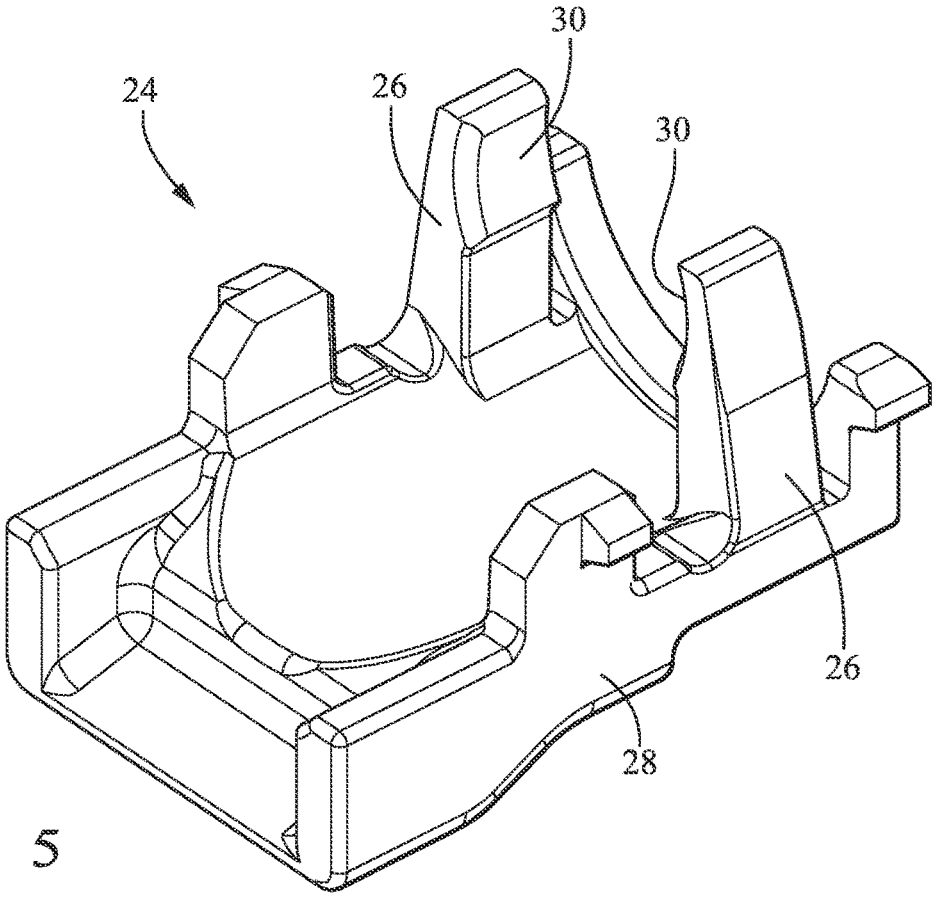
FIG. 5 is a rear perspective view of the independent secondary lock of FIG. 4 according to some embodiments.
Figure 6:
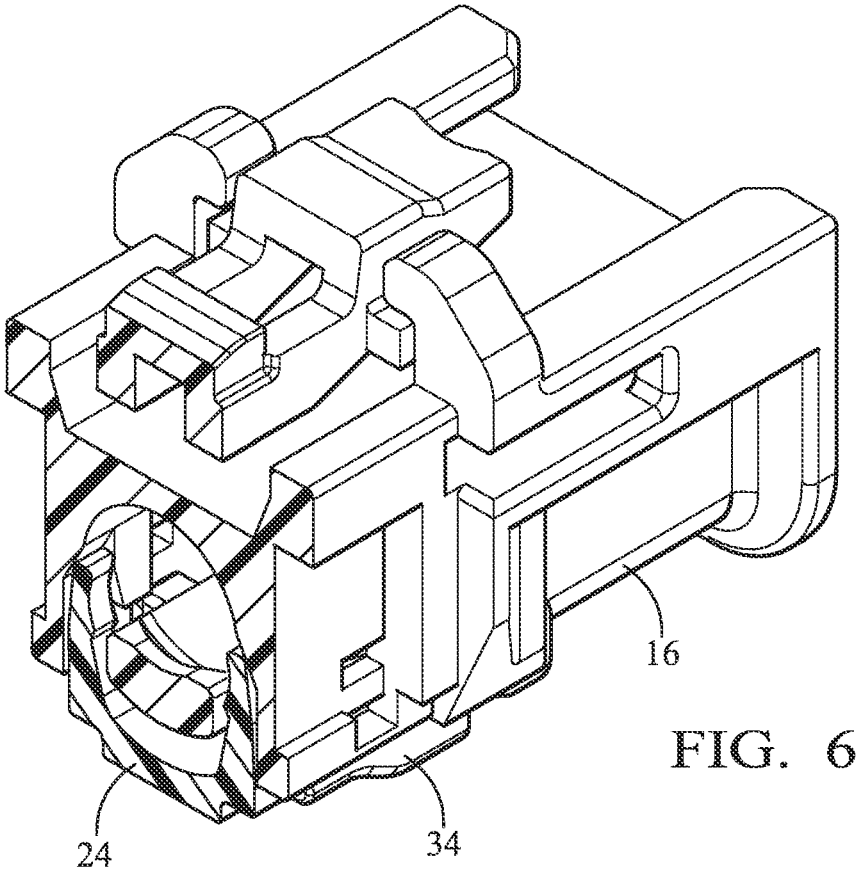
FIG. 6 is a perspective view of the female coaxial connector assembly of FIG. 2 with the independent secondary lock in a pre-staged condition according to some embodiments.
Figure 7:
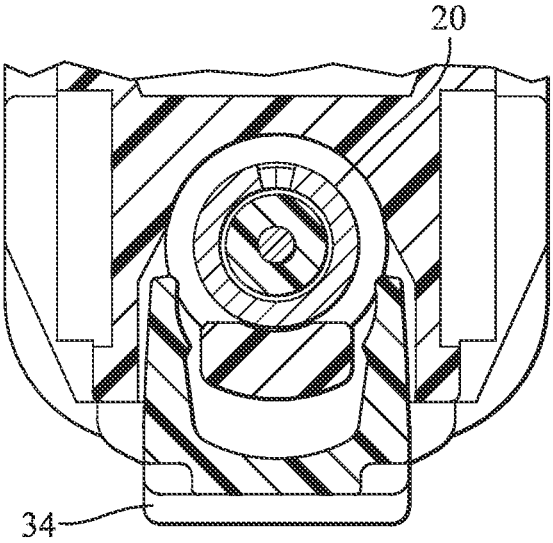
FIG. 7 is an end view of the female coaxial connector assembly of FIG. 2 with the independent secondary lock in the pre-staged condition according to some embodiments.
Figure 8:
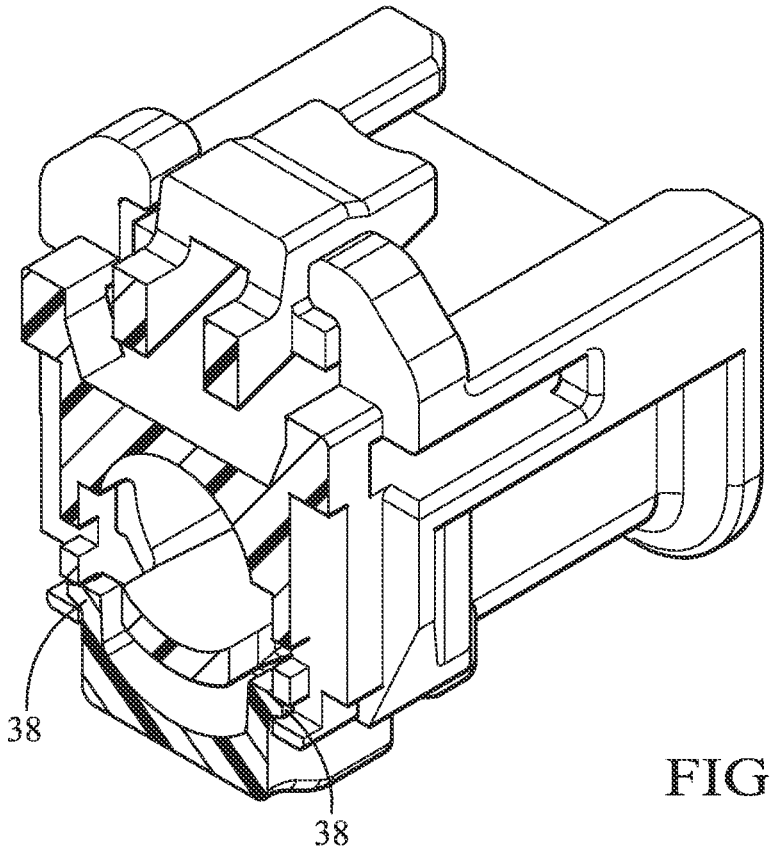
FIG. 8 is perspective lateral cross-section view of the female coaxial connector assembly of FIG. 6 with the independent secondary lock in the pre-staged condition according to some embodiments.
Figure 9:
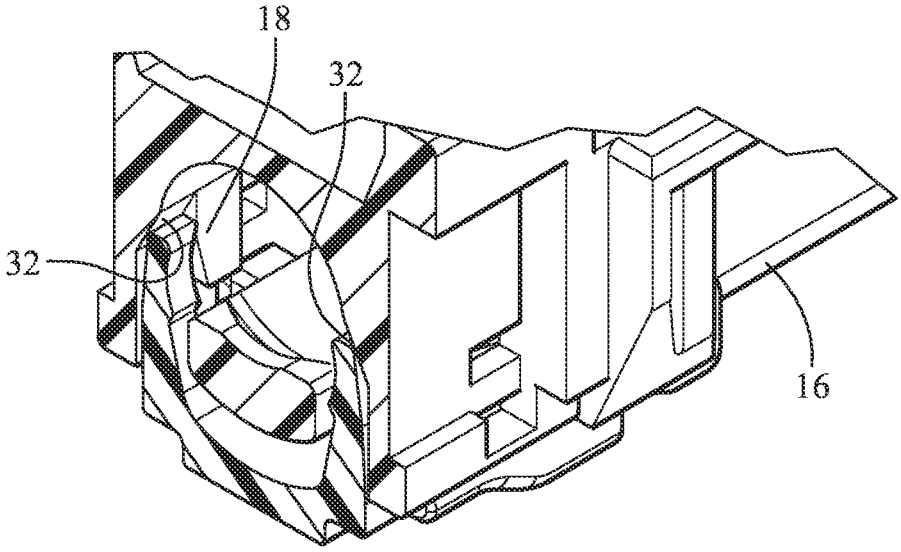
FIG. 9 is a close-up perspective view of the female coaxial connector assembly of FIG. 6 with the independent secondary lock in a pre-staged condition according to some embodiments.
Figure 10:
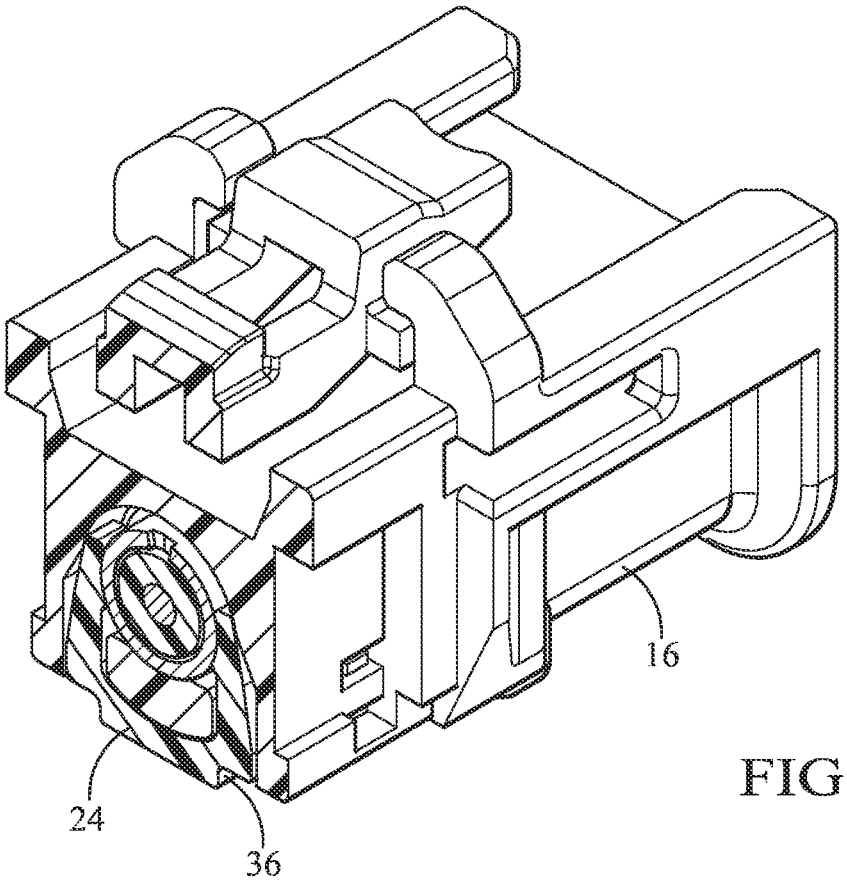
FIG. 10 is a perspective lateral cross-section view of the female coaxial connector assembly of FIG. 2 with the independent secondary lock in a staged condition according to some embodiments.
Figure 11:
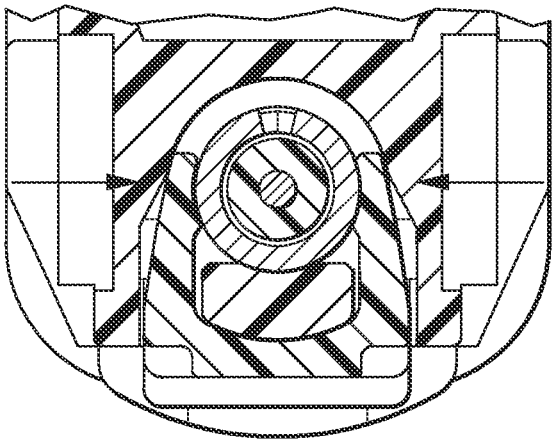
FIG. 11 is an end cross-section view of the female coaxial connector assembly of FIG. 10 with the independent secondary lock in the staged condition according to some embodiments.
Figure 12:
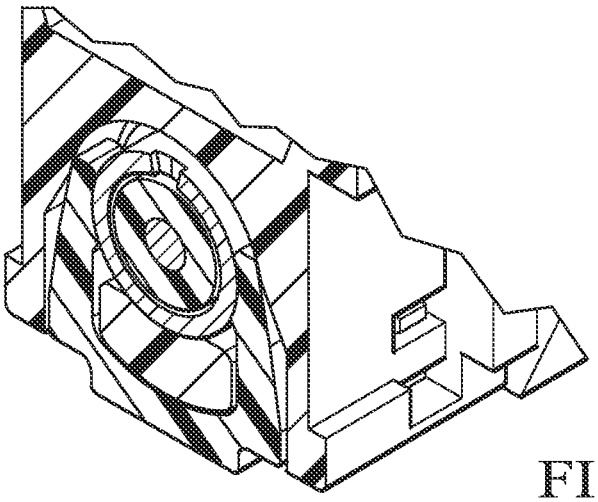
FIG. 12 is a close-up perspective lateral cross-section view of the female coaxial connector assembly of FIG. 10 with the independent secondary lock in the staged condition according to some embodiments.

A nonlimiting example of an embodiment of the coaxial connector assembly 10 is illustrated in FIG. 1. This coaxial connector assembly 10 includes a female coaxial connector assembly 12 as shown in FIG. 2 and a male coaxial connector assembly 14 as shown in FIG. 3. Each of the male and female coaxial connector assemblies 12, 14 include a connector housing 16 defining a cavity 18, a cylindrical coaxial terminal 20 disposed within the cavity 18, a primary terminal locking feature 22, and an integrated secondary terminal locking (ISL) feature 24. As illustrated in FIGS. 4 and 5, the ISL feature 24 has a pair of arms 26 extending from a base 28. The end of each of the arms 26 define concave features 30 that engage the coaxial terminal 20 as the concave features 30 are wedged between the coaxial terminal 20 and inner walls 32 of the cavity 18. The arms 26 and the concave features 30 are wedged between the coaxial terminal 20 and the inner walls 32 of the cavity 18 as the ISL feature 24 is moved from a pre-staged position 34 shown in FIGS. 6-9 to a staged position 36 shown in FIGS. 10-12. As used herein, the term "wedged" means that the concave surfaces 30 are in compressive contact with the coaxial terminal 20 and the arms 26 are in simultaneous compressive contact with the inner walls 32 of the cavity 18. A radius of the concave features 30 is substantially equal to an outer radius of the coaxial terminal 20. As illustrated in FIG. 8, the ISL feature 24 defines pre-locking features 38 in the form of outwardly oriented tabs that are configured to secure the ISL feature 24 to the connector housing 16 when the ISL feature 24 is in the pre-staged position 34.

Figure 13:
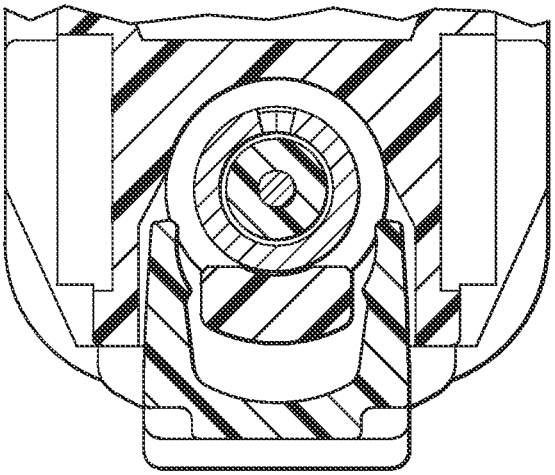
FIG. 13 is an end cross-section view of the female coaxial connector assembly of FIG. 6 with the independent secondary lock in the pre-staged condition according to some embodiments.
Figure 14:
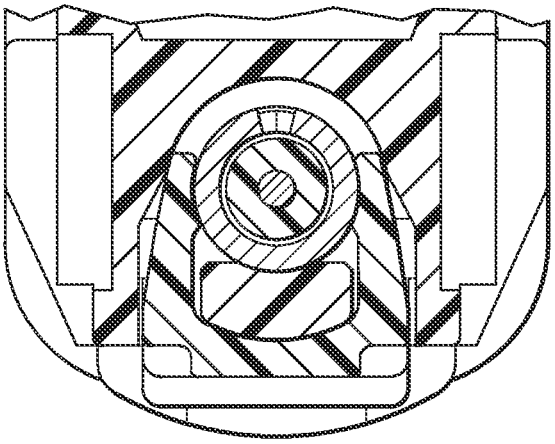
FIG. 14 is an end cross-section view of the female coaxial connector assembly of FIG. 10 with the independent secondary lock in the staged condition according to some embodiments.

As can be seen in FIGS. 13 and 14 the inner walls 32 of the cavity 18 form a ramp that is configured to deflect the pair of arms 26 toward the coaxial terminal 20 as the ISL feature 24 is moved from the pre-staged position 34 to the staged position 36.

Figure 15:
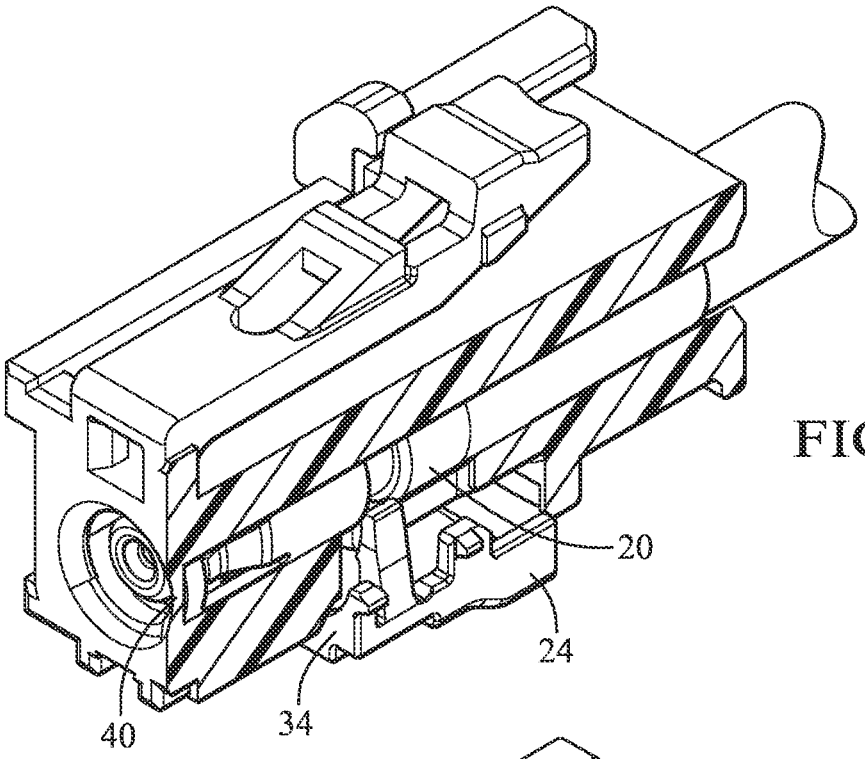
FIG. 15 is a cut-away perspective view of the female coaxial connector assembly of FIG. 6 with the independent secondary lock in the pre-staged condition according to some embodiments.
Figure 16:
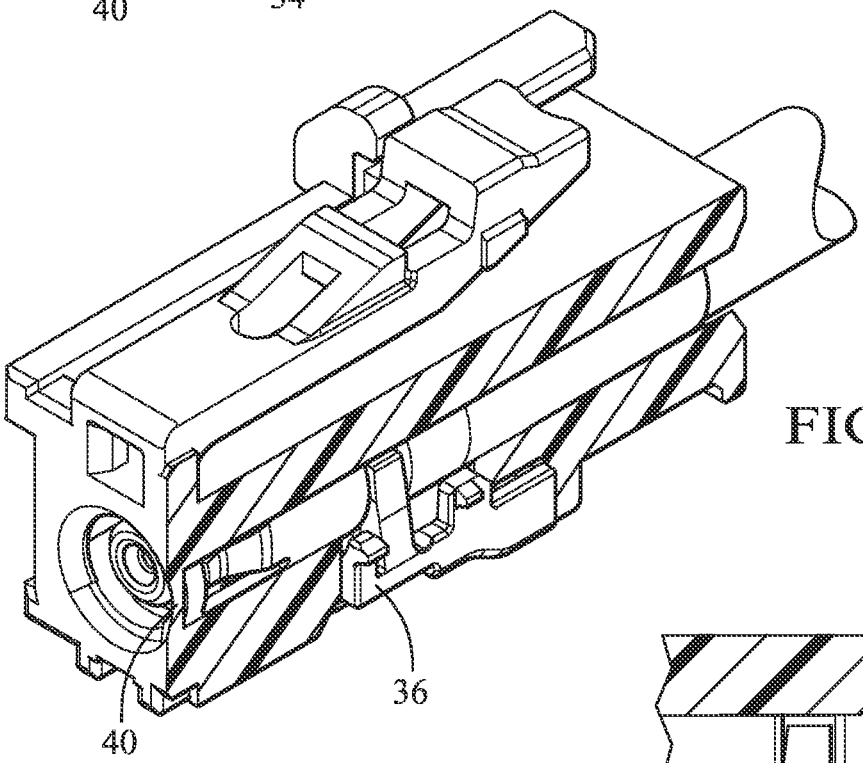
FIG. 16 is a cut-away perspective view the female coaxial connector assembly of FIG. 10 with the independent secondary lock in the staged condition according to some embodiments.
Figure 17:
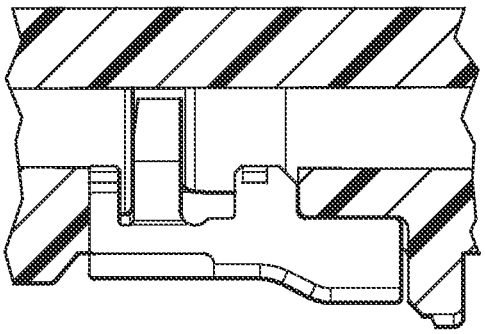
FIG. 17 is a cut-away side view the female coaxial connector assembly of FIG. 10 with the independent secondary lock in the staged condition according to some embodiments.

As shown in FIG. 15-17, the ISL feature 24 is configured to bias the coaxial terminal 20 in an axial direction along the mating axis of the connector assembly 10 toward a forward stop 40 when the ISL feature 24 is in the staged position.

Figure 18:
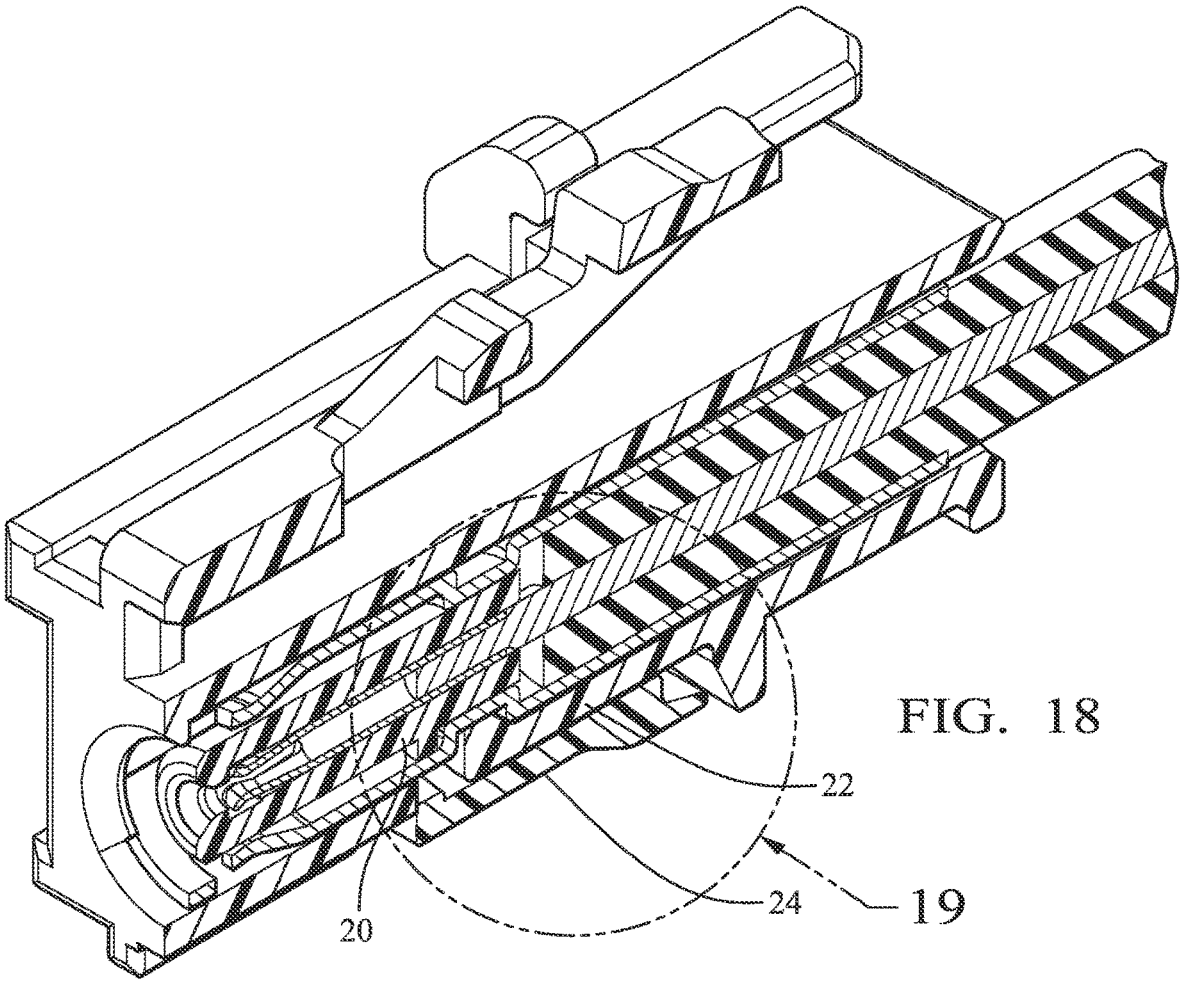
FIG. 18 is a perspective longitudinal cross-section view of the female coaxial connector assembly of FIG. 10 with the independent secondary lock in the staged condition according to some embodiments.
Figure 19:
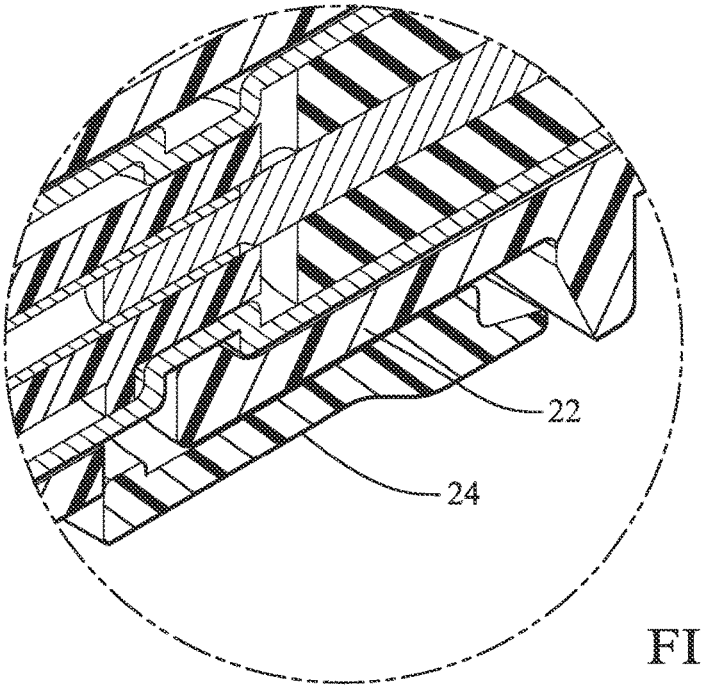
FIG. 19 is a close-up perspective longitudinal cross-section view of the female coaxial connector assembly of FIG. 10 with the independent secondary lock in the staged condition according to some embodiments.

FIGS. 18 and 19 illustrates how the ISL feature 24 also serves as a retainer for the primary terminal locking feature 22 when the ISL feature 24 is in the staged position 36.

Figure 20:
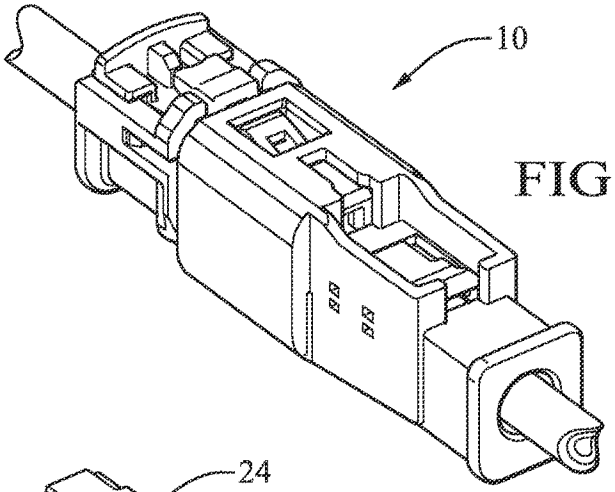
FIG. 20 is a perspective view of a coaxial connector assembly according to some embodiments.
Figure 21:
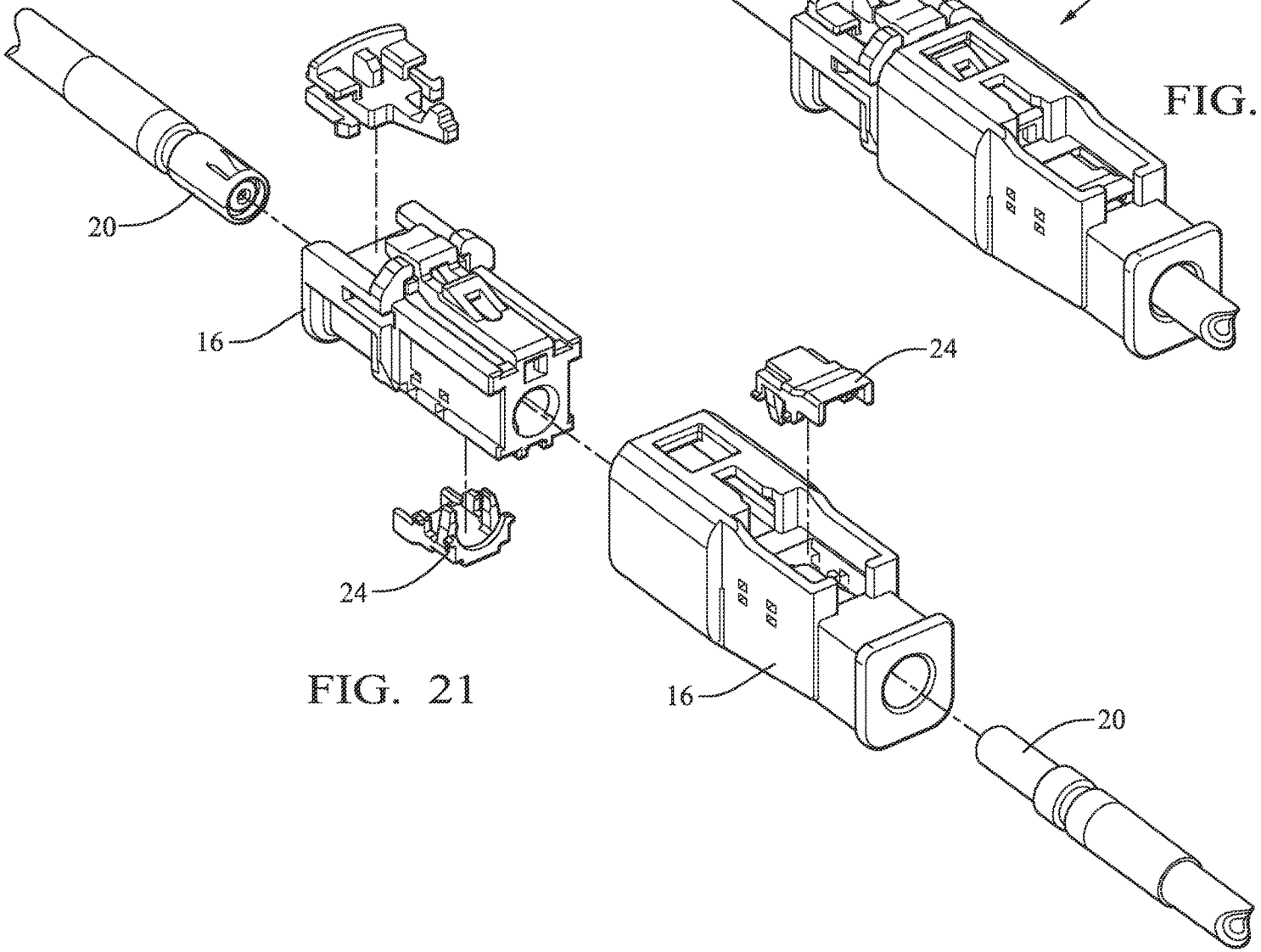
FIG. 21 is an exploded perspective view of the coaxial connector assembly of FIG. 20 according to some embodiments.

FIGS. 20 and 21 illustrate that both the female coaxial connector assembly 12 and the male coaxial connector 14 assembly include the ISL feature 24.

Figure 22:
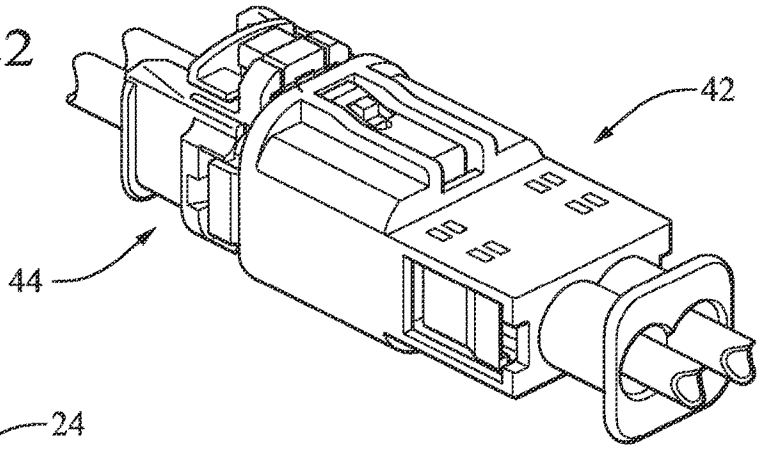
FIG. 22 is a perspective view of a coaxial connector assembly according to some embodiments.
Figure 23:
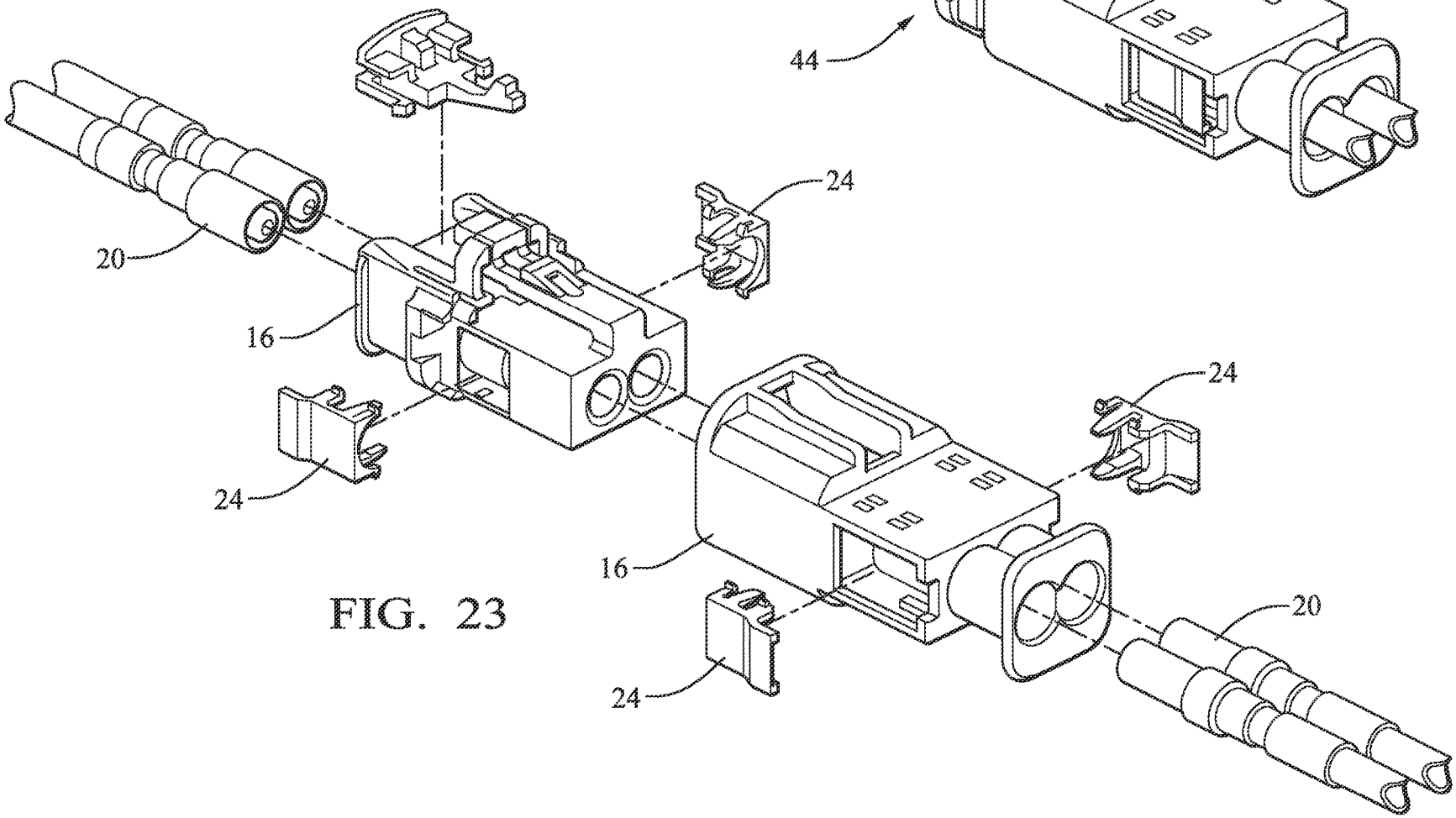
FIG. 23 is an exploded perspective view of the coaxial connector assembly of FIG. 22 according to some embodiments.
Figure 24:
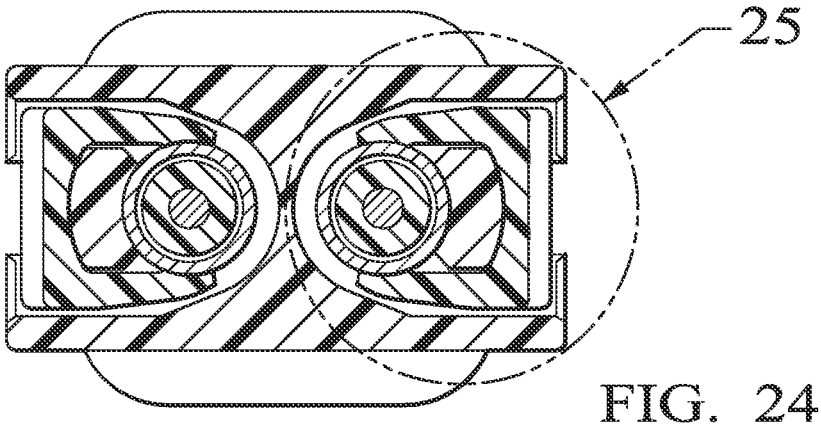
FIG. 24 is an end cross-section view of the coaxial connector assembly of FIG. 22 according to some embodiments.
Figure 25:
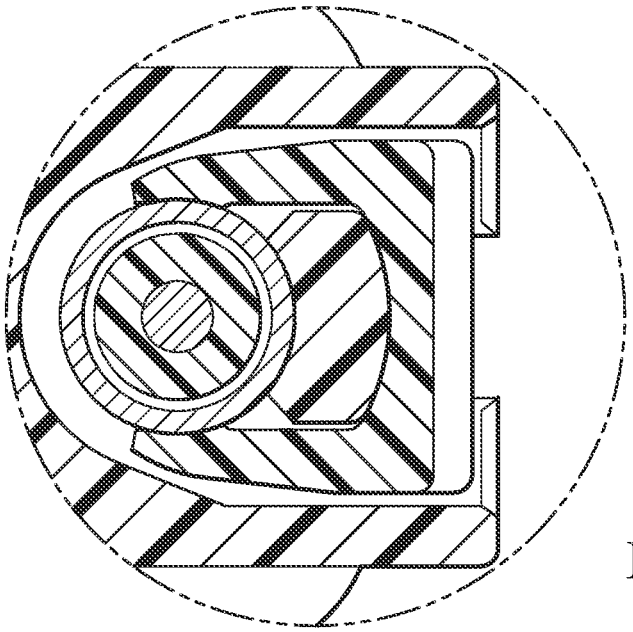
FIG. 25 is a close-up end cross-section view of the coaxial connector assembly of FIG. 22 according to some embodiments.
Figure 26:
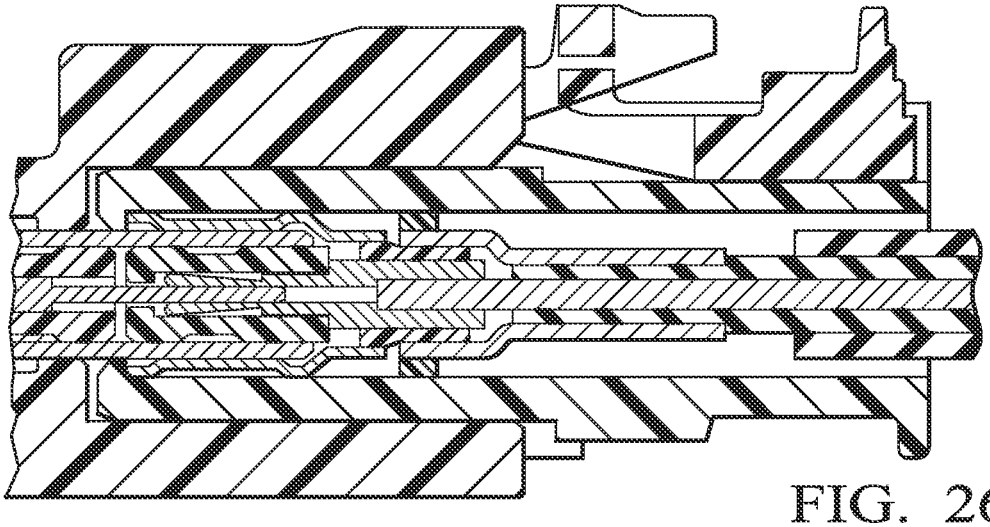
FIG. 26 is a side cross-section view of the coaxial connector assembly of FIG. 22 according to some embodiments.
Figure 27:
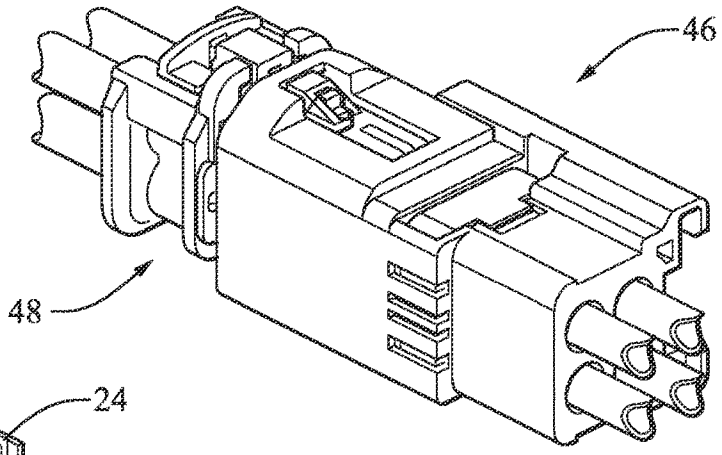
FIG. 27 is a perspective view of a coaxial connector assembly according to some embodiments.
Figure 28:
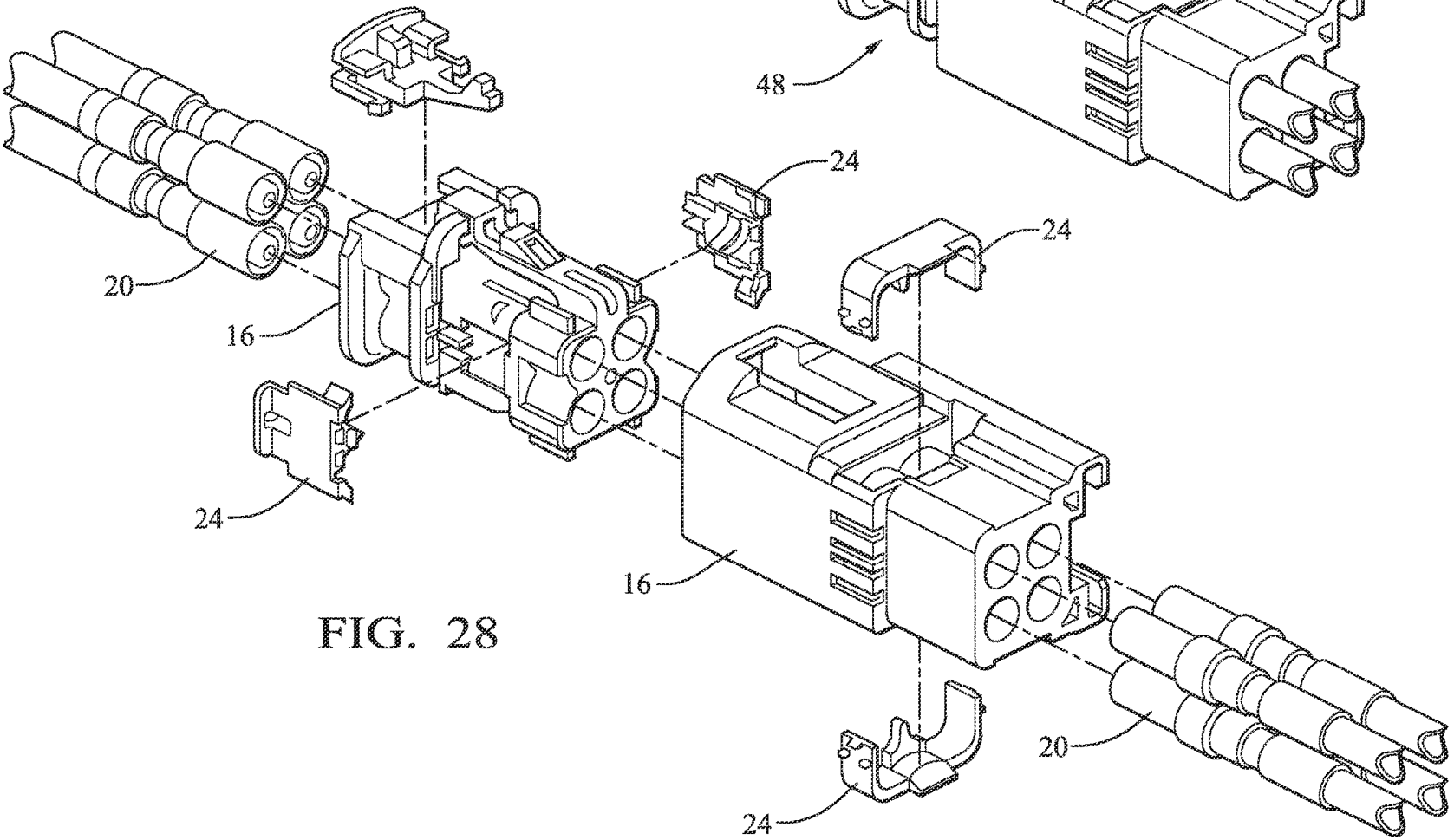
FIG. 28 is an exploded perspective view of the coaxial connector assembly of FIG. 27 according to some embodiments.

FIGS. 22 and 23 illustrate examples of female coaxial connector and male coaxial connector assemblies 42, 44 having two coaxial terminals 20. FIGS. 27 and 28 illustrate examples of female coaxial connector and male coaxial connector assemblies 46, 48 having four coaxial terminals.

The example presented herein is directed to a coaxial electrical connector assembly 10. However, alternative embodiments of the connector assembly may be envisioned to connect fiber optic cables, pneumatic tubes, hydraulic tubes, or a hybrid assembly having a combination of any of these types of conductors.

Accordingly, a coaxial connector assembly 10 is provided. The coaxial connector assembly 10 provide the benefits over the prior art coaxial connector assemblies of providing a clamping feature which in cooperation with the along with the wedge, holds the terminal tight, thereby providing maximum retention forces for the coaxial terminal. The wedging and ramp arrangement in the ISL feature 24 and cavity 18 push the coaxial terminal 20 towards forward stop 40 in the cavity 18 along the axial mating direction, which ensures that the terminal is in proper position and providing maximum interface with mating terminal and arresting the gap between the coaxial terminal 20 and the forward stop 40. A primary lock retainer (PLR) feature integrated with the ISL feature 24 backs up and reinforces primary terminal locking feature 22 in the cavity 18 for increased terminal retention. The ISL feature 24 also provides the benefit of improving signal integrity of the signal conducted by the coaxial connector assembly 10 by reducing skew.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a situation or material to the teachings of the invention without departing from its scope. Dimensions, types of materials, orientations of the various components, and the number and positions of the various components described herein are intended to define parameters of certain embodiments and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'one or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, while terms of ordinance or orientation may be used herein these elements should not be limited by these terms. All terms of ordinance or orientation, unless stated otherwise, are used for purposes distinguishing one element from another, and do not denote any order of arrangement, order of operations, direction or orientation unless stated otherwise.

We claim:

1. A connector assembly, comprising:

a connector housing defining a cavity;

a cylindrical terminal disposed within the cavity;

a primary terminal locking feature configured to retain the cylindrical terminal within the cavity; and a secondary terminal locking feature configured to retain the cylindrical terminal within the cavity having a pair of arms defining concave features that are configured to be wedged between the cylindrical terminal and inner walls of the cavity as the secondary terminal locking feature is moved from a pre-staged position to a staged position, wherein the inner walls of the cavity are angled inwardly to form a ramp configured to deflect the pair of arms toward the cylindrical terminal and force the concave features to engage the cylindrical terminal as the concave features are wedged between the cylindrical terminal and inner walls of the cavity when the secondary terminal locking feature is in the staged position.

2. The connector assembly to claim 1, wherein the secondary terminal locking feature is configured to bias the cylindrical terminal toward a forward stop in the connector housing when in the staged position.

3. The connector assembly to claim 1, wherein a radius of the concave features is substantially equal to an outer radius of the cylindrical terminal.

4. The connector assembly to claim 1, wherein the secondary terminal locking feature defines pre-locking features configured to secure the secondary terminal locking feature to the connector housing in a pre-staged position.

5. The connector assembly to claim 1, wherein the connector housing is configured to contain a male connector.

6. The connector assembly to claim 1, wherein the connector housing is configured to contain a female connector.

7. The connector assembly to claim 1, wherein the connector housing is configured to contain two cylindrical terminals.

8. The connector assembly to claim 1, wherein the connector housing is configured to contain four cylindrical terminals.

9. The connector assembly to claim 1, wherein the cylindrical terminal is a coaxial terminal.

10. The connector assembly to claim 1, wherein the cylindrical terminal is a coaxial electrical terminal and is attached to a coaxial electrical cable.

11. A coaxial electrical connector assembly, comprising:

a connector housing defining a cavity;

a cylindrical coaxial terminal attached to a coaxial cable that is disposed within the cavity;

a primary means for retaining the cylindrical terminal within the cavity; and a secondary means for retaining the cylindrical terminal within the cavity having a pair of arms defining concave features that are configured to be wedged between the cylindrical terminal and inner walls of the cavity as the secondary terminal locking feature is moved from a pre-staged position to a staged position, wherein the inner walls of the cavity are angled inwardly to form a ramp configured to deflect the pair of arms toward the cylindrical terminal and force the concave features to engage the cylindrical terminal as the concave features are wedged between the cylindrical terminal and inner walls of the cavity when the secondary terminal locking feature is in the staged position.

* * * * *